United States Patent [19]

Gall

[11] Patent Number: 4,557,325

[45] Date of Patent: Dec. 10, 1985

[54] REMOTE CONTROL FRACTURE VALVE

[75] Inventor: Adam F. Gall, Charleston, W. Va.

[73] Assignee: McJunkin Corporation, Charleston, W. Va.

[21] Appl. No.: 583,036

[22] Filed: Feb. 23, 1984

[51] Int. Cl.[4] ..... E21B 34/02

[52] U.S. Cl. ..... 166/97; 166/65.1

[58] Field of Search ..... 166/53, 65 R, 97, 75 R, 166/65 M, 316, 308, 305 R, 373, 90; 251/131

[56] References Cited

U.S. PATENT DOCUMENTS

| | | | |
|---|---|---|---|
| 2,871,784 | 2/1959 | Blair | 102/21.6 |
| 3,100,528 | 8/1963 | Plummer et al. | 166/308 |
| 3,328,789 | 6/1967 | Pacheco | 340/224 |
| 3,349,516 | 10/1967 | Armstrong | 49/25 |
| 3,396,107 | 8/1968 | Hill | 166/308 |
| 3,602,304 | 8/1971 | Mallinger et al. | 166/63 |
| 3,665,995 | 5/1972 | Conner, Sr. | 166/65 R X |
| 3,737,845 | 6/1973 | Maroney et al. | 166/65 R X |
| 3,947,907 | 4/1976 | Synodis | 251/131 X |
| 4,073,341 | 2/1978 | Parker | 166/65 R |
| 4,095,421 | 6/1978 | Silcox | 251/131 X |
| 4,102,394 | 7/1978 | Botts | 166/65 R |
| 4,131,883 | 12/1978 | Hollabaugh et al. | 340/310 A |
| 4,340,077 | 7/1982 | Schiffer et al. | 251/131 X |
| 4,344,488 | 8/1982 | Marks | 166/303 |
| 4,407,366 | 10/1983 | Lieffers et al. | 166/305 R |

*Primary Examiner*—James A. Leppink
*Assistant Examiner*—Hoang C. Dang
*Attorney, Agent, or Firm*—Cushman, Darby & Cushman

[57] ABSTRACT

In a petroleum well fracturing context, where the fracturing fluid is an inert gas such as nitrogen, the valve which must be opened to vent the well following high pressurization of the formation for the desired period, is provided with an electric motor actuator which preferably is powered from the 12 volt electrical power of a truck at the site, and reversibly remotely actuated by a transmitter/receiver set of the type commonly used for opening and closing garage doors from a small unit such as may be hand held.

2 Claims, 2 Drawing Figures

SURFACE CASING
CASING
PERFORATIONS
ELECTRICAL CABLE
CONTROL BOX
PUMP
$N_2$
12 VOLT TRUCK BATTERY
TRANSMITTER
PETROLEUM BEARING FORMATION OR ZONE IN WHICH PRODUCTION IS BEING STIMULATED BY FRACTURING
10
12
14
16
18
20
22
24
26
30
32
34
36
38
40
42
44
46
48
50
52
58
60
62
64

REMOTE CONTROL FRACTURE VALVE

BACKGROUND OF THE INVENTION

Quite frequently when a petroleum well is being drilled, and drill stem tests or core samples indicate that one or more stratums traversed by the hole are gas-bearing and/or oil-bearing stratums, the initial rate of flow from the stratum into the hole is far too low to warrant completion of the well. However, such signs, which would seem unpromising and downright discouraging to the uninitiated, are taken as signs for hope and encouragement to those skilled in the petroleum exploration, well-drilling, completion production and servicing fields. The basis for such hope and encouragement is the history of success built-up by those skilled in the art of production stimulation.

Production stimulation has many facets, because many different problems can be encountered at the interface of a bore hole with a petroleum-bearing stratum. Formation plugging due to depositing of the waxy constituents of the petroleum can be a problem, as can silting of the well due to influx of sand from a poorly consolidated stratum, and techniques have been developed for remedying these problems. At the other extreme from the foregoing, where flow at least initially is acceptably high but then is choked-off until a remedy is found, is the problem of tight formations, where the petroleum-bearing stratum naturally is relatively nonporous. However techniques have been developed for remedying this problem as well.

In some instances, e.g. where the oil and/or gas bearing stratum is calcareous, dolomitic acid-dissoluble rock such as limestone, the usual solution of the problem is to pump an inhibited hydrochloric acid solution down the well and out into the formation under high pressure. Then, after the inhibitor chemical which has protected the wellhead, casing and equipment as the solution was being pumped in decomposes, the acid attacks the stone, eating passages through it that will help petroleum to flow towards and into the well.

In other instances, for one reason or another, acidizing is not the answer or at least not the complete answer to curing a low flow rate stemming from tightness of the formation, and for such instances the technique of formation fracturing has been created and developed. In early, often successful attempts at formation fracturing, an explosive charge was lowered into the bore hole to the vicinity of the petroleum-bearing stratum and set off. The resulting concussion fragmented the rock and facilitated the flow of petroleum into the well from the surrounding formation. To a limited extent that mode of fracturing is still carried out. However, in the interests of greater control and better safety, formation fracturing is now more frequently accomplished by pumping a fluid down the bore hole and out into the formation. Then great pressure is applied to it for a substantial length of time, whereupon the pressure is released. As a result, the rock is fractured and the rate of flow of petroleum into the well often is substantially improved. As the fracturing fluid, often a liquid is used. Water and inhibited acid are examples of such working fluids; often propping agents such as sand, glass beads, pulverized nutshells or the like are carried in the liquid so that as the liquid is forced out into the formation and cracks opened up in the rock, the propping agent will invade the cracks and prevent them from closing. On other occasions, the fracturing fluid is a gas, e.g. a relatively inert gas such as molecular nitrogen.

Understandably, the companies and personnel which perform fracturing services are most interested in avoiding damage to equipment and injury or even the fear of injury to personnel as petroleum well formation fracturing is carried out.

In this connection, one stubborn and sticky detail which has often remained a problem, especially where the well is located in a remote area not served by convenient electrical power and an inert gas has been used as the fracturing fluid, is how, safely, to open the fracture valve to vent the gas to atmosphere after the high pressure has been held for the desired length of time. It is the rare person who would feel comfortable merely walking up to the wellhead and turning the fracture valve handwheel in such circumstances, yet heretofore that is exactly what someone often had to do.

The present invention provides a convenient means for actuating a valve such as a petroleum well fracturing valve from a remote, safe location.

SUMMARY OF THE INVENTION

In a petroleum well fracturing context, where the fracturing fluid is an inert gas such as nitrogen, the valve which must be opened to vent the well following high pressurization of the formations for the desired period, is provided with an electric motor actuator which preferably is powered from the 12 volt electrical power of a truck at the site, and reversibly remotely actuated by a transmitter/receiver set of the type commonly used for opening and closing garage doors from a small unit such as may be hand held.

The principles of the invention will be further discussed with reference to the drawing(s) wherein a preferred embodiment is shown. The specifics illustrated in the drawings are intended to exemplify, rather than limit aspects of the invention as defined in the claims.

DETAILED DESCRIPTION

Figure 1:
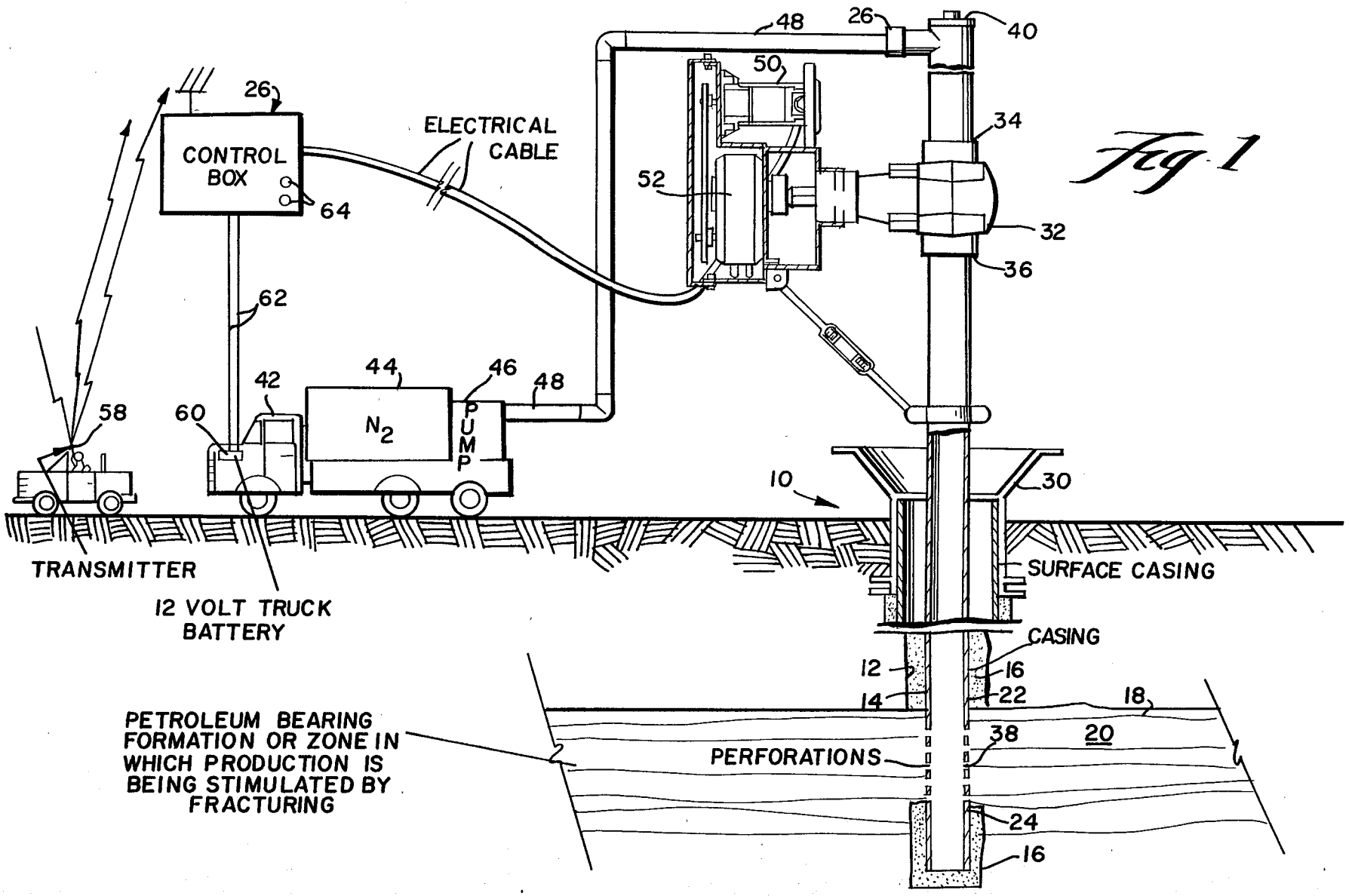
FIG. 1 is a schematic illustration of a petroleum well fracturing operation being carried out using principles of the present invention.
Figure 2:
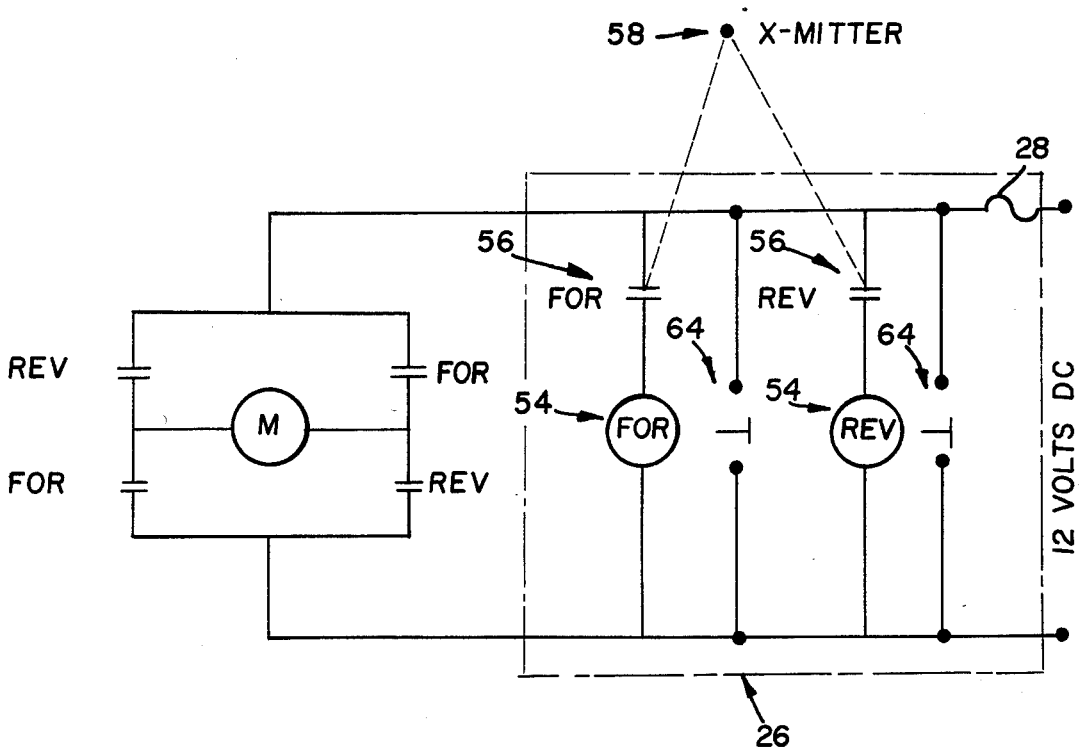
FIG. 2 is a simplified schematic circuit diagram for the apparatus of the invention.

In FIG. 1, a partially completed petroleum well is schematically indicated at 10. In this instance, after the bore hole 12 has been drilled to depth, it has been conventionally lined with casing 14 which has been cemented at 16. At the level of the petroleum-bearing formation 18 which has been intersected by the bore hole, the casing 14 has been perforated as at 38, in order to permit the petroleum to flow from the formation 20 into the well. At the surface, a conventional wellhead 30 is progressively sealingly, securely assembled on the well. Eventually, in addition to a casing head, a tubing head and various spools, mandrels and bonnets, a producing well will include other elements of a christmas tree, e.g. chokes, safety-valves and the like. However, at the stage depicted, the wellhead is represented as including a conventional fracturing valve 32. A typical fracturing valve is made by Demco Incorporated of Oklahoma City, Okla. This part is a very heavy-duty valve which is constructed and arranged to have at least an inlet port 34 for connection to a source of pressurized fluid, and an outlet port 36 for delivering the pressurized fluid to the casing 14.

In the drawing, the means for supplying pressurized fluid to the inlet port of the fracture valve is shown comprising a truck 42 carrying a tank 44 of nitrogen and a pump 46 for pumping nitrogen from the tank 44 through a suitable high pressure conduit 48 connected to the inlet port 34 of the fracture valve. (In practice, the pressurized fluid supply means may be mounted on one or several trucks and/or be partly skid-mounted or rig-mounted.)

When the formation 20 is to be fractured, the valve 32 is actuated to connect the inlet port 34 with the outlet port 36, and the pump 46 is operated to pump fluid from the tank 44 through the conduit 48 and the valve 32, down the casing string 14 and out through the perforations 38, into the formation 20. The extremely high pressure which is pumped on the working fluid causes the working fluid to split and crack the formation, creating and enlarging paths for oil and/or gas to flow into the well. For the period of time that the formation is to be subjected to the high pressure, the valve 32 may remain open between the pump and the formation if continued pressurization is needed to counteract the loss of pressure into the formation. However in some instances, the decline in pressurization is sufficiently small that the valve 32 may be closed after the initial pressurization. In any event, after the formation has been pressurized for the desired length of time, it is necessary to release the pressure from the formation and well casing through the valve 32.

As mentioned hereinbefore, often until now, the pressure has been released by having someone manually open the valve 32.

However, in accordance with principles of the present invention, when apparatus such as described is assembled for fracturing the formation 20, the valve 32 has its usual manual actuator (such as a handwheel or lever on its stem) replaced by or supplemented by an electrically powered automatic actuator, e.g. in the form of an explosion-proof, permanent magnet-type D.C. motor 50 reversibly operatively connected to the valve 32 by a suitable conventional power transmission means, e.g. a speed reducer 52. The reversible D.C. motor 50 typically is provided with a set of coils which, if energized in one direction operates the motor in one angular sense and if energized in the opposite direction operates the motor in the opposite angular sense. Accordingly, the motor 50 is conventionally provided with a suitable switch, e.g. a reversing electronic contactor 54 which may be activated from an "off" position to either a "forwards" position or a "reverse" position. By preference, the contactor 54 is a normally off device which, if not actuated, remains off or switches to its "off" position.

For actuating the contactor 54, there is provided a receiver unit 56 which is constructed and arranged to be controlled by a transmitter unit 58. In fact, the transmitter unit 58, and receiver unit 56 (incorporating the switch 54), are or may be of a set commercially available radio-control garage door opener/closer units, e.g. a model 1098 transmitter and a model 1090 receiver available from Multi-Elmac of Nori, Mich., in which the receiver unit comprises two receivers (one for receiving a signal equating to a command to open the garage door and another for receiving a signal equating to a command to close the garage door), and the transmitter unit comprises two corresponding transmitters or one capable of transmitting two correspondingly different signals.

The electrical power for the motor 50 may be conveniently supplied from one of the trucks on the site by hooking into its electrical power take-off, e.g. by wiring the switch 54 in circuit with the motor 50 and these elements in circuit with the 12 volt truck battery 60 via wiring 62.

Accordingly, when the time comes to open the valve 32, a coupling may be opened in the conduit 48 at 26 thus, disconnecting the pressurizing equipment 44, 46 from the valve 32. Then, an orifice fitting (not shown) e.g. a 4 inch to one-fourth inch reducer may be made up on the conduit 26 to provide a vent to atmosphere at 40. Then, the valve 32 may be safely opened from up to a hundred or more feet away, merely by pushing the usual button on the transmitter unit 58 which is marked "Up" or "Open" or the like, with opposite movement of the valve actuator being accomplished by instead pushing the usual button on the transmitter unit 58 which is marked "Down" or "Close". In a typical well fracturing operation using the apparatus and method of the present invention, the valve 32 is closed while the pressurizing apparatus 44, 46, 48 is being attached to the well, open while the well is being pressurized, closed while the pressurizing apparatus is being disconnected from the well, and then open while the well pressurization is bled to atmosphere through the reducer 40.

Although not presently preferred, the valve 32 could be selected to be of the three port type, having a distinct vent-to-atmosphere port through an orifice. In such a case, the pressurizing equipment 44, 46 could remain physically connected to the valve inlet port 34 by the conduit 48 as the pressurized valve casing 14 was vented to atmosphere through the vent port of such a three port-type valve.

In the preferred embodiment illustrated, the control box 26 includes in addition to the reversing contactor 54 and the receivers 56, a circuit breaker 28 and hardwired, push button-operated switches 64 for manually operating the reversing contactor 54 in case the transmitter/-receiver units 58/56 malfunction, or are selected not to be used. The electrical cable from the control box 26 to the motor 50 preferably is several feet long, for instance sixty feet long.

In any event, by the means just described, a problem which until now has persisted in the field of the invention may be easily overcome.

It should now be apparent that the remote control fracture valve as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. In combination:

a petroleum well including a bore hole at least partially cased by a casing which is perforated at a level corresponding to a petroleum-bearing formation which is intersected by said bore hole;

the casing being sealingly-surmounted by a wellhead which includes a fracture valve, said fracture valve having at least one port means constructed and arranged to be alternatively communicated to a source of pressurized fracturing fluid and the atmosphere, another port means constructed and arranged to be communicated to said casing and thus to said petroleum-bearing formation, and a valve member actuable to a first position to open the fractive valve in such a sense as to communicate. said casing through said fracture valve with only one of said source of pressurized fracturing fluid and the atmosphere, and to a second position to close the fracture valve in such a sense as to isolate said casing from both said source of pressurized fracturing fluid and the atmosphere;

an electrically-powered, reversible actuator operatively connected with the fracture valve;

a trasmitter unit/receiver unit remote control set of the garage door opener/closer type, this set having the receiver unit operatively connected with said electrically-powered reversible actuator for powering the actuator in one sense to move the valve member towards and to said first position upon receiving a first form of signal from said transmitter unit, and for alternatively powering the actuator in another sense to move the valve member towards and to said second position upon receiving a second form of signal from said transmitter unit;

said transmitter unit being constructed and arranged to send a signal of the first form through the air to said receiver unit upon being manually correspondingly actuated remotely from the receiver unit and to send a signal of the second form through the air to said receiver unit upon being manually correspondingly actuated remotely from the receiver unit;

said electrically power reversible actuator including a reversible D.C. motor, a speed reducer means constructed and arranged for operatively connecting said motor with said fracture valve, a switch means operatively connected with said D.C. motor for alternatively powering said D.C. motor in one angular sense, powering said D.C. motor in an opposite angular sense, and interrupting power to said D.C. motor; and a source of D.C. electrical power connected in circuit with said switch and said motor, said source of D.C. electrical power being an electrical power take off on an on-site truck.

2. The apparatus of claim 1, wherein:

said electrical power take off is constituted by an electrical storage battery positive terminal and a ground terminal of said on-site truck.

* * * * *